US005223169A

United States Patent [19]

El-Sayed et al.

[11] Patent Number: 5,223,169

[45] Date of Patent: Jun. 29, 1993

[54] HYDROLASE SURFACTANT SYSTEMS AND THEIR USE IN LAUNDERING

[75] Inventors: Maha Y. El-Sayed, Fremont; Susan A. Anderson, Menlo Park; Sheldon N. Lewis, Lafayette; Richard J. Wiersema, Tracy, all of Calif.

[73] Assignee: The Clorox Company, Oakland, Calif.

[21] Appl. No.: 743,519

[22] Filed: Aug. 12, 1991

Related U.S. Application Data

[63] Continuation-in-part of Ser. No. 351,781, May 15, 1989, abandoned.

[51] Int. Cl.[5] ..... C11D 1/32

[52] U.S. Cl. ..... 252/174.12; 252/8.75; 252/8.9; 252/174.21

[58] Field of Search ..... 252/174.12, 8.75, 8.9, 252/174.21

[56] References Cited

U.S. PATENT DOCUMENTS

| | | | |
|---|---|---|---|
| 3,944,470 | 3/1976 | Diehl et al. . | |
| 3,950,277 | 4/1976 | Stewart et al. | 252/117 |
| 4,707,291 | 11/1987 | Thom et al. | 252/174.12 |
| 4,707,292 | 11/1987 | Sano et al. | 252/174.16 |
| 4,707,293 | 11/1987 | Ferro | 252/174.17 |
| 4,981,611 | 11/1991 | Kolattukudy et al. | 252/174.12 |
| 5,030,240 | 7/1991 | Wiersema et al. | 252/95 |
| 5,108,457 | 4/1992 | Poulose et al. | 252/174.12 |

FOREIGN PATENT DOCUMENTS

| | | |
|---|---|---|
| 0204284 | 12/1986 | European Pat. Off. . |
| 0205208 | 12/1986 | European Pat. Off. . |
| 0206390 | 12/1986 | European Pat. Off. . |
| 0214761 | 3/1987 | European Pat. Off. . |
| 0218272 | 4/1987 | European Pat. Off. . |
| 0224971 | 6/1987 | European Pat. Off. . |
| 0258068 | 3/1988 | European Pat. Off. . |
| 0268456 | 5/1988 | European Pat. Off. . |
| 63-78000 | 4/1988 | Japan . |
| 87/00859 | 2/1987 | PCT Int'l Appl. . |
| WO88/09367 | 12/1988 | PCT Int'l Appl. . |

OTHER PUBLICATIONS

Andree et al., "Lipases as Detergent Components," Journal of Applied Biochemistry 2, pp. 218-229 (1980).

Köller et al., "Mechanism of Action of Cutinase: Chemical Modification of the Catalytic Triad Characteristic for Serine Hydrolases," Biochemistry, 21, pp. 3083-3090 (1982).

Wills, E. D., "The Effect of Surface Active Agents . . . , etc.", Biotech. vol. 60, pp. 529-534 (1955).

Ettinger, "Structure of Cutinase Gene, . . . etc.", Biochem. pp. 7883-7892 (1987).

Antonian, E., "Recent Advances in Purification, . . . etc.", Lipids, vol. 23 pp. 1101-1106 (1988).

Sebastian et al., "Purification and Characterization of Cutinase . . . etc" Archives of Biochemistry and Physics, vol. 263, No. 1, May 15, pp. 77-85 (1988).

*Primary Examiner*—Anthony McFarlane

*Attorney, Agent, or Firm*—Millen, White, Zelano & Branigan

[57] ABSTRACT

The inactivation in a laundry solution of a hydrolase enzyme by surfactant is prevented by the presence in the laundry solution of an amount of a non-charged enzyme activating means selected from oily hydrocarbons, hydrolyzable fatty acid ester substrates for the enzyme, e.g., triglycerides, essentially lipophilic organic compounds which are not substrates for the enzyme and which bear a polar substituent, and non-ionic surfactants which lower the oil to enzyme critical minimum molar ratio required to activate the enzyme.

50 Claims, No Drawings

HYDROLASE SURFACTANT SYSTEMS AND THEIR USE IN LAUNDERING

This is a continuation-in-part of application Ser. No. 07/351,781, filed May 15, 1989, now abandoned.

FIELD OF THE INVENTION

The present invention relates to hydrolase enzyme compositions useful in removing oily stains from fabrics and to methods for removing oily stains and soils therewith, including a method for rendering surfactant-containing hydrolase enzymatic laundry compositions and solutions optimally operable.

BACKGROUND OF THE INVENTION

A well known class of hydrolase enzymes are lipases, of which microbial and fungal cutinases [Purdy et al., Biochem. 14:2831-2840 (1975)] are especially useful for laundry applications because they hydrolyze oily stains and are active in the pH 8-11 range, which is typically employed in laundry solutions.

Lipases are hydrolase enzymes naturally produced by a wide variety of living organisms from microbes to higher eukaryotes. Fatty acids undergoing oxidation in tissues of higher animals must be in free form (that is, non-esterified) before they can undergo activation and oxidation. Thus, intracellular lipases function to hydrolyze the triacylglycerols to yield free fatty acids and glycerol.

Bacterial lipases are classically defined as glycerolesterhydrolases (EC 3.1.1.3) since they are polypeptides capable of cleaving glycerol ester bonds. They have a high affinity for interfaces, a characteristic which distinguishes them from other enzymes such as proteases and esterases. An interface onto which lipases readily absorb is that of oil/water.

Cutinases are hydrolase enzymes that catalyst the hydrolysis of cutin. For example, cutinase allows fungi to penetrate through the cutin barrier into the host plant during the initial stages of a fungal infection. The primary structures of several cutinases have been compared and shown to be strongly conserved. Ettinger, *Biochemistry*, 26, pp. 7883-7892 (1987). Sebastian et al., *Arch. Biochem. Biophys.*, 263 (1), pp. 77-85 (1988) have recently found production of cutinase to be induced by cutin in a fluorescent *P. putida* strain. This cutinase catalyzed hydrolysis of p-nitrophenyl esters of $C_4$-$C_{16}$ fatty acids.

Lipases have long been considered as potential components in detergent compositions. An early preparation of lipase in the form of pancreatin was taught for addition to detergent formulations by Rohm, *Chem. Abs., Int.*, P2048 (1916). More recently, lipases obtained from certain Pseudomonas or Chromobacter microorganisms have been disclosed as useful in detergent compositions: Thom et al., U.S. Pat. No. 4,707,291, issued Nov. 17, 1987 and Wiersema et al., European Patent Application 253,487, published Jan. 20, 1988.

Lipases have long been known generally to be inhibited by anionic detergents and by nonionic detergents. Lipase activity has been reported as enhanced by emulsifiers such by Wills, *Bioch.*, 60, pp. 529-534 (1955) and Andree, et al., *J. App. Biochem.*, 2, pp. 218-229 (1980). Not withstanding such teachings, attempts to use lipases in laundry solutions which contain anionic or nonionic surfactants have been largely unsuccessful, and effective use of lipases for cleaning oily stains have been limited to presoak applications.

U.S. Pat. No. 3,950,277, inventors Stewart et al., issued Apr. 13, 1976 describes pre-soak compositions employing a lipase enzyme and a lipase activator selected from the group consisting of naphthalene sulfonates, certain polyoxylalkylene derivatives of ethylene diamine and certain acylamino acid salts.

Lipases are useful in the absence of surfactant for removing oily stains and soil from fabrics by using them in aqueous solutions for prewash or presoak applications over extended periods of time, followed by a conventional washing with a fully formulated detergent. Under these conditions, lipases are effective in removing natural oil (triglyceride-containing) stains. However, despite many attempts to use lipases commercially in detergent-containing laundering solutions, the demonstrated washing benefit has been disappointing because lipases generally do not function in a predictably satisfactory manner in the presence of surfactants.

Attempts have recently been made to find specific lipases that are less adversely affected by the surfactants in wash solutions. Japanese Patent Application 63039579, published Feb. 20, 1988 states that a novel lipase obtained from a Pseudomonas is only slightly inhibited by anionic surfactants and is activated by nonionic surfactants.

European Patent Application 258,068, published Mar. 2, 1988 reports a lipase from the genus Thermomyces said to be compatible with anionic surfactants and effective as a detergent additive.

European Patent Application 268,456 discloses an enzymatic peracid bleaching system for in situ generation of peracid, which is useful for laundry bleaching and which employs (a) a novel enzyme having hydrolase activity (isolatable from *Pseudomonas putida* (ATCC 53552); (b) a hydrolyzable substrate capable of peroxidation, such as a triglyceride, e.g., trioctanoin and tridecanoin; and (c) a source of peroxyoxygen which, by reaction with (a) and (b), produces a peracid. Unlike that system, the present invention is not peracid based and does not require the relatively longer period of time required to form peracid for operability although, like that process, the compound which it employs as an activator for the enzyme can be a triglyceride.

U.S. Pat. No. 4,981,611 states that combinations of a cutinase enzyme and a nonionic, anionic, cationic or zwitteronic surfactant are useful as cleaning agents and that two or more surfactants exhibit a synergistic effect with respect to hydrolysis activity. However, only the combination of Triton X-100 (octoxynol) and SDS (sodium dodecyl sulfate) and the bacterial cutinase from ATCC 53552 was disclosed in support of the latter property and the single claims of that patent is limited to that specific combination. In actual fact, only certain types of surfactants are capable of preventing the inactivating effect of most surfactants.

There is no published explanation for the compatibility or incompatibility of specific lipases with various laundry and cleaning formulations, and notwithstanding the disclosure of general compatibility of cutinase enzymes with surfactants in U.S. Pat. No. 4,981,611, it has been generally recognized in the art that many surfactants when present in conventional concentrations in wash water often partially or completely inhibit the hydrolysis activity of most lipases. As a consequence, extended presoaking of oily soiled or stained fabrics in a lipase solution in the absence of surfactant is required in order to ensure that the desired enzymatic hydrolysis of any oily soil or stains will occur.

We have found that the hydrolysis inhibiting activity of surfactants as a class on the oily soil and stain removing enzymatic activity of hydrolase enzymes generally can be suppressed or eliminated by the presence of an effective amount of a non-charged hydrolysis activator, such as a lipophilic compound, e.g., an oily liquid or semi-solid hydrocarbon, of a natural or synthetic fatty ester, a substantially water insoluble hydrocarbon bearing a polar functional group, and certain non-ionic surfactants, which amount varies from lipase to lipase and from type of surfactant to type of surfactant. With this knowledge, hydrolase-based detergent compositions and laundry additive compositions which are effective in surfactant-containing laundry water and which have effective oily stain and soil removing activity can be formulated.

OBJECTS OF THE INVENTION

It is an object of the present invention to provide novel hydrolase enzyme compositions which are hydrolytically active in all conventional, surfactant-containing aqueous environments, such as laundering solutions.

It is another object to provide a method for measuring the compatibility or incompatibility of hydrolase enzymes with surfactants and for formulating hydrolase laundry additive compositions which are effective in laundry water containing any conventional detergent.

It is another object to provide a method of rendering a hydrolase enzyme operable in surfactant-containing laundering solutions.

It is a further object to provide a method of removing oily stains and soil from soiled fabric with the aid of a hydrolase enzyme in surfactant-containing laundering solutions.

Other objects will be apparent to those skilled in the art to which this invention pertains.

SUMMARY OF THE INVENTION

In one composition aspect, the present invention relates to enzyme additive compositions for laundry applications comprising, per usage dose, an amount of a hydrolase enzyme capable, in the absence of a surfactant, of hydrolyzing the triglycerides in oily stains or soil in a fabric and an amount of a non-charged hydrolysis activator effective to prevent inhibition of such hydrolysis by a conventional amount of surfactant present in a laundry solution to which the enzyme additive composition is added.

In another composition aspect, this invention relates to laundry detergent compositions comprising a hydrolase enzyme at a concentration therein effective, in the absence of a surfactant, to hydrolyze triglycerides present in oily stains or soil in a conventional load of stained or soiled fabric; a surfactant at a concentration which would at least partially inhibit the aforesaid hydrolysis of such stains in an aqueous solution containing only the enzyme and the surfactant; and a non-charged hydrolysis activator, at a concentration effective to prevent the aforesaid inhibition by the surfactant.

In a process aspect, this invention relates to a method of enzymatically hydrolyzing with a hydrolase enzyme the triglycerides in an oily stained or soiled fabric in an aqueous solution which contains an amount of a surfactant capable of inhibiting the hydrolyzing activity of the enzyme in the absence of a hydrolysis activator, which comprises adding to the aqueous solution, in addition to the soiled fabric, the enzyme and the surfactant, an amount of a non-charged hydrolysis activator effective to activate the enzyme in the presence of the surfactant.

In another process aspect, this invention relates to an improved method of removing oily stains or soil from soiled fabric by hydrolysis of the triglycerides in the stain or soil with a hydrolase enzyme wherein the soiled fabric is contacted with an aqueous solution containing the enzyme, which process comprises employing an aqueous solution containing (a) an amount of a surfactant which, in the absence of (b), would at least partially inhibit the hydrolyzing activity of the enzyme; and (b) an amount of a non-charged hydrolysis activator effective to activate the hydrolysing activity of the enzyme in the presence of the surfactant.

In another process aspect, this invention relates to a method for selecting a laundry system which contains both a hydrolase enzyme and a surfactant which inhibits the hydrolyzing enzymatic activity of the enzyme, which laundry system is effective to remove oily stains and soil on fabrics at least partially enzymatically.

In still another process aspect, this invention relates to a method for rendering a hydrolase enzyme-containing laundry additive composition enzymatically predictably effective in assisting in the removal of oily stains and soil from fabric in laundry solutions containing a conventional amount of a separately added, surfactant-containing laundry detergent, which comprises adding to the enzyme composition an amount of a hydrolase activator, effective to prevent the solution from inhibiting the enzymatic activity of the enzyme added thereto.

Other aspects and advantages of the invention will become apparent to those skilled in the art upon reading the following description.

DETAILED DISCLOSURE

We have discovered that the onset of hydrolysis of the glycerides present in oily stains or soil on fabric by a hydrolase enzyme in a laundry solution containing a surfactant occurs only if the laundry solution contains a non-charged enzyme hydrolysis activator in an amount which exceeds a critical minimum ratio (referred to herein after as the "critical ratio") relative to the amount of surfactant(s) present in the solution.

It has been discovered that such enzymes will "turn on" and hydrolyze oily stains and soil in the presence of a surfactant only if the ratio of "oil", i.e., hydrolysis activator, to surfactant in the laundry solution exceeds a certain minimum ratio, the value of which is dependent upon both the identity of the surfactant and the enzyme. The oil present in the stains and soil is sometimes but usually not sufficient to meet this minimum ratio. A hydrolysis activator increases the system ratio of oily components to surfactant in a laundry solution in which a composition of this invention is employed. If this ratio exceeds the critical ratio for the specific enzyme and surfactant, the enzyme will "turn on" and hydrolyze the oil stain in the presence in a laundry solution of an otherwise inactivating amount of surfactant.

Fabrics cleaned in laundering solutions according to this invention include natural, e.g., cotton, linen, silk and woolen and synthetic materials, e.g., polyester, nylon, acetate, triacetate, acrylic, polyolefin, etc., and blends thereof, e.g., polyester-cotton, which are soiled by an oil or grease which contains a hydrolyzable component, e.g., body oils (sebum), food and cooking oils.

Mono-, di- and triglycerides are present in sebum soils and cooking oils and enzymatic hydrolysis thereof facilitates removal of the soil and stains containing them.

HYDROLYZING ENZYMES

The hydrolyzing enzymes employed in this invention are those having sufficient hydrolytic activity in water or in a non-inhibiting surfactant-containing laundering solution to hydrolyze at least about 5 wt. % of the total oil stain within about 14 to 15 minutes at about 25° C. Examples of such enzymes are lipases and especially cutinases. A particularly preferred enzyme for use in the present invention is isolatable from *Pseudomonas putida* (hereinafter "*P. putida*") ATCC 53552. This enzyme also has peroxidizing activity which is the basis for its use in the peracid bleaching compositions of European Application 268,456. However, its hydrolyzing activity is much more efficient than its peroxidizing activity.

Analysis of the amino acid sequence for a recently discovered enzyme described as having lipase activity and isolatable from *P. putida* ATCC 53552 suggests there are substantial homologies between the nucleotide sequence for this enzyme and the nucleotide sequence of the cutinase gene recently determined for *C. capsici*. (Compare European Patent Application 268,456, inventors Wiersema et al., published May 25, 1988 with Ettinger et al., Biochemistry, 26, pp. 7883–7892 (1987)). Enzymes which can be employed in the present invention include cutinases and other lipases which are capable of hydrolyzing triglyceride on fabric in aqueous solution, which are sometimes hereinafter described as glycerol ester hydrolases. Such enzymes useful in the present invention are typically obtained from certain Pseudomonas, Chromobacter, Fusarium or Aspergillus strains, for example, those expressed by genes from *P. sp.* (as Amano 68S), from *P. fluorescens* (as Amano P), and from *Aspergillus oryzae* (as Lipolase). Toyo Jozo Co. of Japan, U.S. Biochemical Co. of the U.S.A. and Diosynth Co. of The Netherlands sell lipases from *Chromobacter viscosum*. European Patent Applioation No. 0214761, published Mar. 3, 1987, (Novo Industri), describes a lipase from *Fusarium oxysporum*. Other strains are known or described as producing lipases. For example, PCT/WL86/00023, published Feb. 12, 1987, (Gist-Brocades, N.V.), describes strains including certain Acinetobacter. It should be understood that the genes expressing such enzymes can be cloned into another organism such as *E. coli*, for higher levels of expression.

Hydrolysis Activators

We have discovered that an enzyme which would otherwise be inactivated by the presence of a surfactant can be activated, i.e., "turned on" in the presence of the inactivating surfactant, by non-charged lipophilic oily compounds which are dispersible or at most only slightly soluble, e.g., no more than 1% and preferably less than 0.1% and most preferably less than 0.01%, in water, e.g., oils, essentially lipophilic compounds, which can either be a substrate for the enzyme, such as naturally occurring or synthetic partially unsaturated or hydrogenated mono-, di- and triglycerides and mixtures thereof and other non-charged substantially hydrocarbonaceous functional group-containing essentially water insoluble compounds, non-substrates for the enzyme, e.g., hydrocarbons, of which hexadecane and octadecane are preferred examples.

Because the oils in oily stains and dirt in soiled laundry are activators for hydrolase enzymes, they can contribute to the ratio of activators to surfactant(s) in the laundry solution. However, because the amount thereof is usually insufficient to raise the ratio above the critical ratio when the enzyme is used in combination with a conventional amount of a conventional laundry detergent, those oils in the soiled laundry must be supplemented by additional oil or other hydrolysis activator intentionally added to the laundry solution, either by its presence in the detergent composition or in the enzyme additive composition.

Examples of non-charged essentially lipophilic organic compounds which do not participate in the hydrolysis reaction, i.e., are not substrates for the enzyme, are those which are water insoluble and preferably contain few to no polar groups (because polar groups tend to interfere with enzyme activity). However, if the organic compound's polar groups are hindered or obscured by suitable branched or long chain alkyl groups, then some polarity can be tolerated. A charged substituent, e.g., a salt of a carboxylic, sulfonic or sulfate group, ordinarily should not be present. Examples of substantially insoluble organic compounds (which do not act as substrates for the enzyme) are esters, e.g., butyl acetate, butyl butylate, butyl stearate, butyl propionate, ethyl caprylate, glycol (diol) ether and esters, such as alkylene, e.g., diethylene, glycol fatty acid, e.g., monolaureate esters and alkylene, e.g., ethylene glycol, propylene glycol and alkyl, e.g., dimethyl, ethers; higher alcohols, such as lauryl alcohol, lipophilic aldehydes and ketones, such as methyl butyl ketone, methyl nonyl ketone; and fatty acid amides, e.g., N,N-diethyldodecanamide.

The most preferred of these hydrolysis activators have a solubility, δ, in water of between about 7–9.5, in accordance with the formula $$\delta = \frac{\Sigma G\, d}{M}$$

where ΣG is the sum for all the atoms and groupings in the molecule, d is the density, and M, the molecular weight. Especially preferred are compounds with a δ solubility of between about 8.0–9.0, such as are illustrated and described by J. Brandrup and E. H. Immergut, Eds., *Polymer Handbook*, 2d Ed., John Wiley & Sons, 1975), pp. IV-337 to IV-353, incorporated herein by reference. It may be that these substantially insoluble organic compounds, preferably with few to no polar groups are sufficiently chemically analogous to the oils (substrate or not) as to increase the total "effective" oil concentration. Thus, such substantially insoluble, substantially lipophilic organic compounds represent another embodiment of the means for increasing the system ratio of oil to surfactant.

Although surfactants generally have an inactivating effect upon hydrolase enzymes, certain non-ionic surfactants are capable of acting as hydrolysis activators. We have found that certain nonionic surfactants are capable of dramatically reducing the critical ratio of an ionic surfactant itself. Like the lipophilic oils, the non-ionic surfactants which are activators are uncharged and are primarily hydrocarbonaceous (except for a recurring polar linking polymer group).

U.S. Pat. No. 4,981,611 incorrectly states that two or more surfactants show a synergistic increase in the hydrolytic activity of cutinase. Actually, only certain non-ionic surfactants are able to counteract the hydrolysis inhibiting effect of surfactants generally, such as anionic and cationic surfactants.

We have also found that, surprisingly, to varying degrees, certain mixtures of an inactivating, e.g., anionic, surfactant and certain non-ionic surfactants have lower critical oil-to-surfactant activating ratios than the anionic surfactant alone, which critical ratio can even be lower than that of the non-ionic surfactant alone. In fact, the critical ratio can sometimes be lowered by a non-ionic surfactant enough that a composition consisting essentially only of a hydrolase enzyme such a non-ionic surfactant is effective in counteracting the inhibiting effect on the hydrolyzing activity of the enzyme of the surfactant or surfactants present in commercial laundry products containing an ionic surfactant, thus rendering feasible a hydrolase-containing detergent laundry additive and compositions whose enzymatic oily soil and stain removing activity is not inhibited by the surfactants in the laundry solution, i.e., the combination of surfactants are sufficient to provide a system ratio of hydrolysis activators to surfactants which is above the critical minimum ratio for that specific enzyme(s) and the surfactants therein.

A class of non-charged nonionic surfactants which either alone or in combination with the surfactant in the detergent present in the laundry solution used to wash the soiled fabric can be used as a hydrolysis activator to counteract the hydrolysis inhibiting effect of surfactants generally are aliphatic higher alkyl (more than 6 carbon atoms) polyalkyleneoxy compounds having an alkyleneoxy to alkyl molecular weight ratio from about 1:1 to about 3:1. Such compounds generally also have a molecular weight ratio of alkyl groups to oxy oxygen atoms from about 1:1 to about 2:1. An example of such aliphatic non-charged surfactants are those of the formula $$H—(C_nH_{2n})_x—(OC_mH_{2m})_y—H$$

wherein x is a number from 7 to 15, preferably from 9 to 15; y is a number from 5 to 12; preferably from 6 to 12; n and m each are a number from 2 to 4; the alkyl groups can be branched or straight chained and can be a mixture, i.e., different alkyl groups on different molecules; and the alkyleneoxy group can be a mixture, in sequence or in blocks, e.g., a mixture of ethyleneoxy and propylene-2-oxy or butylene-2-oxy groups.

Hydrolysis Activator to Surfactant Critical Ratio

The ability of a hydrolase enzyme to hydrolyze the ester groups of natural oils, viz., mono-, di- and triglycerides, in an aqueous solution containing a surfactant is dependent upon both the specific surfactant and the ratio of hydrolysis activator(s) to surfactant in the solution. The ratio of the hydrolysis activators collectively to surfactant(s) in the aqueous solution of interest is sometimes hereinafter called the "system ratio", in contradistinction to the minimum ratio of activators to surfactant required for hydrolysis to begin, which is called the "critical ratio." Although the ratio is most conveniently calculated and expressed on a molar basis, it can be based on bulk weight, if desired, because the numerical values are not critical and vary from enzyme to enzyme and surfactant. What is critical is that the system ratio exceed the critical ratio.

As stated above, the "system ratio" expresses the relationship of the combined amount of oil and/or other hydrolysis activator present in the system to the amount of the specific surfactant present therein. At and above the critical ratio, the molar relationship is such that the enzyme is activated, or "turned on", that hydrolysis can begin, irrespective of the concentration of both components in an aqueous medium, such as wash water solution, provided the molar (or weight) relationship between the two components remains at or above the critical ratio at any selected dilution in the aqueous medium.

To determine the critical ratio for any specific enzyme-surfactant combination, aliquots of an aqueous solution, each containing a determined (constant) amount of the enzyme which is effective in the absence of any surfactant to hydrolyze the triglycerides in an oily stain on a determined (constant) amount of a fabric soiled by a determined (constant) amount of a triglyceride oil, are mixed with a determined (constant) amount of a surfactant which is within the range of the amounts conventionally present in home laundry solutions, e.g., from about 0.2 to 1.5. mM, and which is effective to inhibit the hydrolyzing activity of the enzyme. To the aliquots are added a hydrolysis activator, e.g., trioctanoin, in increasing amounts and the hydrolyzing activity of the enzyme in the various solutions is determined. The ratio of the minimum amount of hydrolysis activator to the surfactant at which significant hydrolysis occurs, e.g., 10% of the maximum, is the critical ratio for that enzyme-surfactant combination.

As stated above, the critical ratio varies, from enzyme to enzyme, from hydrolysis activator to activator and from surfactant to surfactant, some times dramatically. With most enzymes, the critical molar ratio varies from as slow as about 0.5 to 30 or higher, i.e., a minimum of from about 0.5 mole of hydrolysis activator to about 30 moles per mole of inactivating surfactant must be present in the laundry solution in order for the enzyme to be "turned on."

As also stated above and as illustrated hereinafter, although all surfactants thus far tested singly have an hydrolysis inhibiting effect to at least some extent for substantially all hydrolase enzymes, surprisingly and inexplicably some pairs of surfactants react synergistically to produce a critical ratio lower than that of either surfactant alone for the same enzyme. In fact, some surfactants can act as hydrolysis reactor, i.e., can alone provide a system ratio of activator to inactivating surfactant which is above the critical ratio.

In the examples which follow, various lipases and cutinases are shown to have related, but different, critical ratios, which applicants have determined empirically through their above-described model. One key aspect of the critical ratio model is a focus upon the amount of oily substrate present relative to the amount of surfactant, rather than on the amount of enzyme or surfactant. By contrast, the prior art has assume that either using large amounts of enzymes or surfactant will result in enhanced cleaning performance. But following teachings or assumptions of the such prior art leads one to using wastefully or ineffectively large amounts of enzyme, surfactant, or both.

The molecular weights of various surfactants (and typical structures) and oils discussed hereinafter are set out below.

| Compound | Nominal Molecular Weight* |
|---|---|
| SDS (sodium dodecylsulfate) surfactant | 288 |

-continued

| Compound | Nominal Molecular Weight* |
|---|---|
| $C_{12}$LAS surfactant | 362 |
| Neodol 25-9 surfactant | 596 |
| Neodol 25-3S surfactant | 444 |
| Surfonic JL80X surfactant | 625 |
| Triton X-100 surfactant | 624 |
| $C_{16}$DAPS surfactant | 392 |
| Trioctanoin substrate | 470 |
| Triolein substrate | 884 |

*Used for calculations of molarity, and calculated as if for pure surfactant.
The structures of conventional surfactants are:
$C_{12}H_{25}$—O—$SO_3Na^+$ (SDS);
$C_{12}H_{25}$—$C_4H_4$—$SO_3Na^+$ ($C_{12}$LAS);
($C_{12}$—$C_{15}$) ($H_{25}$—$H_{31}$)—$(OCH_2CH_2)_9$—H (Neodol 25-9);
($C_{12}$—$C_{13}$) ($H_{25}$—$H_{27}$)—$(OCH_2CH_2)_{6.5}$—H (Neodol 23-6.5);
$C_{9-11}H_{19-23}$—$O(CH_2CH_2O)_{4.5}$—$(CH(CH_3)$—$CH_2O)_{1.5}$—$(CH_2CH_2O)_{4.5}H$ (Surfonic JL80X);
$C_8H_{17}$—$C_4H_4$—$(OCH_2CH_2)_{10}$—H (Triton X-100);
$C_{16}H_{33}$—$\overset{+}{N}(CH_3)_2$—$(CH_2)_3$—$SO_3$); and
($C_{12}$—$C_{15}$) ($H_{25}$—$H_{31}$)—$(OCH_2CH_2)_3$—O—$SO_3Na^+$ (Neodol 25-3S).

The following table is a list of commercial liquid and solid detergent compositions and the type and amount of surfactant(s) therein (1990–1991 period), the molar concentration of surfactant which each provides in the wash water, based on the average amount thereof used per wash in the U.S.A., and the minimum enzyme activating molar ratio (R) of activating oil (trioctanoin) to surfactant ratio required to activate lipase enzyme A.T.C.C. 9 at a 0.1 mM oil load concentration employing that detergent composition.

TABLE I

| Detergent | Composition | Use (mM)[a] | Total | Use (R)[b] |
|---|---|---|---|---|
| | A. Powdered Deterents | | | |
| Tide with Bleach | 10% NaLAS | 0.52 | | |
| | 4% NaAS | 0.20 | 0.9 | 0.12 |
| | 3% Soap | 0.19 | | |
| | 1% Neodol 23-6.5 | 0.03 | | |
| Tide | 12% NaLAS | 0.5 | | |
| | 4% NaAS | 0.16 | 0.68 | 0.16 |
| | 1% Neodol 23-6.5 | 0.02 | | |
| Cheer | 10% NaLAS | 0.41 | | |
| | 4% NaAS | 0.16 | 0.59 | 0.19 |
| | 1% Neodol 23-6.5 | 0.02 | | |
| Surf | 14% NaLAS | 0.62 | 0.64 | 0.17 |
| | 1% Alfonic 1214-GC-57 | 0.02 | | |
| Arm and Hammer | 3% NaAEOS | 0.11 | 0.22 | 0.55 |
| | 3% Neodol 25-3 | 0.11 | | |
| UCD | 2% NaLAS | 0.10 | 0.28 | 0.40 |
| | 7% Neodol 25-9 | 0.18 | | |
| | B. Liquid Detergents | | | |
| Tide | 10% NaLAS | 0.7 | | |
| | 10% NaAEOS | 0.35 | 1.4 | 0.08 |
| | 3% Soap | 0.25 | | |
| | 3% Neodol 23-6.5 | 0.11 | | |
| Wisk | 10% NaLAS | 0.64 | | |
| | 7% NaAEOS | 0.22 | 1.1 | 0.1 |
| | 7% Neodol 25-7 | 0.23 | | |
| All | 14% NaLAS | 0.9 | | |
| | 5% Neodol 25-7 | 0.16 | 1.1 | 0.1 |

[a]mM calculations based on average detergent use in the U.S.A. (Table VI).
[b]R = use ratio, assuming 0.11 mM total oil load Initiation of substrate hydrolysis by the glycerol ester hydrolase depends on the system ratio rather than the concentration of either substrate (triglyceride) or surfactant.

An example of the effect of the system ratio on hydrolysis of the substrate by a glycerol ester hydrolase is illustrated by Table IA where enzymatic activity was monitored for a number of different trioctanoin concentrations at two different surfactant concentrations. The surfactant used for the Table IA data was a zwitter ionic salt sometimes abbreviated $C_{16}$DAPS ("Zwittergent 3-16" available from Calbiochem).

TABLE IA

| Oil[1] Conc. (mM) | Surfactant[2] Conc. (mM) | System Ratio | Enzyme Activity[3] |
|---|---|---|---|
| 0.5 | 0.5 | 1 | 0 |
| 10 | 10 | 1 | 0 |
| 2.5 | 0.5 | 5 | 0 |
| 50 | 10 | 5 | 0 |
| 5 | 0.5 | 10 | 0 |
| 10 | 0.5 | *20 | 334 |
| 200 | 10 | #20 | 398 |
| 15 | 0.5 | 30 | 405 |
| 300 | 10 | 30 | 370 |
| 20 | 0.5 | 40 | 370 |
| 400 | 10 | 40 | 417 |

[1]Trioctanoin
[2]Zwittergent 3-16
[3]Initial rate of hydrolysis measured as $\mu$mole $H^+$ released · $min^{-1}$ · $mgE^{-1}$ of enzyme from *P. putida* ATCC 53552 (2 ppm)
[4]Indicates the system ratio exceeded critical ratio As may be seen from the data of Table IA, there is either no enzyme activity (that is, the enzyme is "turned off") or observable hydrolase activity, depending upon the system ratio, and independent of the surfactant concentration. This data shows that neither the absolute concentration of the triglyceride nor the absolute concentration of the surfactant determines whether or not the enzyme is active. Instead, it is the ratio of the oil to surfactant that best describes the kinetic profile of enzyme activity. For the enzyme tested in Table IA, the value of the critical ratio (i.e., system ratio at which enzymatic activity begins) with respect to this particular zwitterionic surfactant is between 10 and 20. At and below the system ratio value of 10, the enzyme is not active. At and above the system ratio value of 20, the enzyme is active.

Another example of this phenomenon, using another surfactant with which the *P. putida* ATCC 53552 enzyme displays a different critical ratio, sodium oleate, is presented in Table IB.

TABLE IB

| Na Oleate (mM) | System Ratio | Enzyme Activity |
|---|---|---|
| 0.3 | 1 | 0 |
| 0.3 | 5 | 0 |
| 0.3 | 10 | 0 |
| 0.3 | 20 | 60 |
| 0.3 | 30 | 90 |

The substrate used for the data of Table IB was triolein. The concentrations (not shown) were varied to produce the system ratios indicated. The sodium oleate surfactant used in the experiment summarized by Table IB is interesting because oleic acid is a product of reaction hydrolysis.

The experiments determining enzyme activity, such as those set out in Tables IA and IB, were carried out as follows:

(i) Sample Preparations:

The desired amount of triglyceride was weighed into an appropriate size beaker, on a Mettler balance (model number AE163). The corresponding amount of surfactant was added to the triglyceride, from a previously prepared aqueous surfactant stock solution, and the triglyceride and surfactant mixed manually. The sample was then adjusted to the desired weight using doubly distilled $H_2O$. Emulsification of the sample was carried out, prior to assaying enzyme activity, with a probe sonicator (Braun-Sonic model 2000), on ice, for approx. 2 minutes.

(ii) Enzyme Activity Measurement:

This was achieved by monitoring the rate of acid liberation, from the enzymatic hydrolysis of the triglycerides in the emulsion. The assay was initiated by adding approx. 2 ppm lipase to 10 ml of the prepared emulsion. The acid liberated was monitored by autotitration, on a Radiometer pH-stat (model number ABU80) to an endpoint of a pH of 10. Initial rates were recorded for the first 5 minutes of the reaction, and the reaction rates reported as $\mu$mole $H^+$ titrated . min $^{-1}$mgE$^{-1}$. Occasionally enzyme activity is reported as % total oil hydrolyzed in 14 min. In these examples, the reaction was allowed to run for 14 min. and the amount of acid titrated recorded. The % total oil (triglyceride) hydrolyzed was then calculated by dividing the recorded value with the theoretically calculated value assuming three equivalents of oleic acid was produced for each triglyceride equivalent. All assays were run at ambient temperatures.

The dependency of the onset of hydrolysis upon a critical ratio of oil to surfactant in aqueous solution is not specific to the particular glycerol ester hydrolase used for the data of Table IA and Table IB; rather, the principle has been discovered to be general for other glycerol ester hydrolases. This is shown by Tables II–V, which show the critical ratio for a variety of different nonionic and anionic surfactants and several different enzymes (where the substrate was trioctanoin). The various enzymes examined as shown by Tables II–V were also examined at higher surfactant concentrations and the dependency upon the system ratios was confirmed.

TABLE II (Enzyme isolatable from *P. putida* ATCC 53552)

| Surfactant Type & Conc. | Critical Ratio | Enzyme Activity* |
|---|---|---|
| Anionic[1], 2 mM | 0.5–5.0 | 325 |
| Anionic[2], 1 mM | 5–10 | 250 |
| Anionic[3], 2 mM | 0.5–1 | 300 |
| Nonionic[4], 0.5 mM | 10–20 | 450 |
| Nonionic[5], 0.5 mM | 5–10 | 500 |
| Nonionic[6], 2 mM | 10–15 | 450 |

[1]SDS (sodium dodecylsulfate)
[2]$C_{12}$LAS (available from Pfaultz and Bauer Inc.)
[3]Neodol 25-3S (available from Shell)
[4]Neodol 25-9 (available from Shell)
[5]Surfonic JL-80X (available from Texaco)
[6]Triton X-100 (available from Rohm and Haas)
*As described by footnote 3 in Table IA.

TABLE III (Enzyme Amano P., available from Amano Co., isolatable from *Pseuomonas fluroescens*)

| Surfactant Type & Conc. | Critical Ratio | Enzyme Activity* |
|---|---|---|
| Anionic[1], 2 mM | 1–5 | 100 |
| Anionic[2], 1 mM | 5–20 | 70 |
| Anionic[3], 2 mM | 10–20 | 200 |
| Nonionic[4], 0.5 mM | 1–5 | 400 |

TABLE III-continued (Enzyme Amano P., available from Amano Co., isolatable from *Pseuomonas fluroescens*)

| Surfactant Type & Conc. | Critical Ratio | Enzyme Activity* |
|---|---|---|
| Nonionic[5], 0.5 mM | 0.5–1 | 550 |

[1]SDS
[2]$C_{12}$LAS
[4]Neodol 25-3S
[4]Neodol 25-9
[5]Surfonic JL-80X
*As described by footnote 3 in Table IA.

TABLE IV (Enzyme Amano 68S, available from Amano Co., isolatable from *P. sp.*)

| Surfactant Type & Conc. | Critical Ratio | Enzyme Activity* |
|---|---|---|
| Anionic[1], 1 mM | 0.1–0.5 | 400 |
| Anionic[2], 0.2 mM | 5–10 | 175 |
| Anionic[3], 0.5 mM | 1–5 | 200 |
| Nonionic[4], 0.5 mM | ≦0.1 | 750 |
| Nonionic[5], 0.5 mM | 0.5–1 | 700 |

[1]SDS
[2]$C_{12}$LAS
[3]Neodol 25-3S
[4]Neodol 25-9
[5]Surfonic JL-80X
*As described by footnote 3 in Table IA.

TABLE V (Enzyme Lipolase, available from Novo Industri, isolatable from *A. oryzae*)

| Surfactant Type & Conc. | Critical Ratio |
|---|---|
| Anionic[2], 0.5 mM | 0.5–1 |
| Anionic[3], 0.5 mM | 20–30 |
| Nonionic[4], 0.5 mM | 20–30 |
| Nonionic[5], 0.5 mM | 10–20 |

[2]$C_{12}$LAS
[3]Neodol 25-3S
[4]Neodol 25-9
[5]Surfonic JL-80X

As can be seen by Tables I–V, the critical ratios for particular enzymes are dependent upon surfactant identity.

The following Tables VI–IX show that hydrolysis is also dependent upon substrate type. The data of Tables VI–IX was collected using triolein as the oil (rather than trioctanoin as in Tables I–V).

TABLE VI (Enzyme from *P. putida* ATCC 53552)

| Surfactant Type & Conc. | Critical Ratio | Enzyme Activity* |
|---|---|---|
| Anionic[1], 1 mM | 5–10 | 60 |
| Anionic[2], 0.5 mM | 5–10 | 50 |
| Anionic[3], 1 mM | 1–5 | 125 |
| Nonionic[4], 0.5 mM | 10–20 | 60 |
| Nonionic[5], 0.5 mM | 0.5–1.0 | 150 |

[1]SDS
[2]$C_{12}$LAS
[3]Neodol 25-3S
[4]Neodol 25-9
[5]Surfonic JL-80X
*As described by footnote 3 in Table IA.

TABLE VII (Enzyme Amano P)

| Surfactant Type & Conc. | Critical Ratio | Enzyme Activity* |
|---|---|---|
| Anionic[1], 1 mM | 5–10 | 160 |

TABLE VII-continued

| Surfactant Type & Conc. | Critical Ratio | Enzyme Activity* |
|---|---|---|
| | (Enzyme Amano P) | |
| Anionic[2], 0.5 mM | 10–20 | 13 |
| Anionic[3], 0.5 mM | 5–10 | 20 |
| Nonionic[4], 0.5 mM | 5–10 | 20 |
| Nonionic[5], 0.5 mM | 5–10 | 40 |

[1]SDS
[2]$C_{12}$LAS
[3]Neodol 25-3S
[4]Neodol 25-9
[5]Surfonic JL-80X
*As described by footnote 3 in Table IA.

TABLE VIII

| Surfactant Type & Conc. | Critical Ratio | Enzyme Activity* |
|---|---|---|
| | (Enzyme Amano 68S) | |
| Anionic[1], 1 mM | 1–5 | 200 |
| Anionic[2], 0.5 mM | 10–20 | 30 |
| Anionic[3], 0.5 mM | 5–10 | 25 |
| Nonionic[4], 0.5 mM | 1–5 | 30 |
| Nonionic[5], 2.5 mM | 1–5 | 40 |

[1]SDS
[2]$C_{12}$LAS
[3]Neodol 25-3S
[4]Neodol 25-9
[5]Surfonic JL-80X
*As described by footnote 3 in Table IA.

TABLE IX

| Surfactant Type & Conc. | Critical Ratio |
|---|---|
| (Enzyme Lipolase) | |
| Anionic[2], 0.5 mM | 30–40 |

[2]$C_{12}$LAS

The above data may be summarized by the "Table Summary" below where "++" means a critical ratio of 0.01–0.1, "+" means a critical ratio of 0.1–1.0, "0" means a critical ratio of 1.0–10, and "–" means a critical ratio of 10–100.

TABLE SUMMARY

| (Trioctanoin as substrate) Surfactant | Enzyme: From ATCC 53552 | Amano P | Amano 68S | Lipolase |
|---|---|---|---|---|
| Anionic[1], 2 mM | 0 | 0 | + | ND |
| Anionic[2], 1 mM | 0 | 0 | 0 | + |
| Anionic[3], 2 mM | + | – | 0 | – |
| Nonionic[4], 0.5 mM | – | 0 | ++ | – |
| Nonionic[5], 0.5 mM | 0 | + | + | – |
| Nonionic[6], 2 mM | – | ND | ND | ND |
| Anionic[1], 2 mM | 0 | 0 | 0 | ND |
| Anionic[2], 1 mM | 0 | – | – | – |
| Anionic[3], 2 mM | 0 | 0 | 0 | ND |
| Nonionic[4], 0.5 mM | – | 0 | 0 | ND |
| Nonionic[5], 0.5 mM | + | 0 | 0 | ND |

[1]SDS (sodium dodecylsulfate)
[2]$C_{12}$LAS (available from Pfaultz and Bauer Inc.)
[3]Neodol 25-3S (available from Shell)
[4]Neodol 25-9 (available from Shell)
[5]Surfonic JL-80X (available from Texaco)
[6]Triton X-100 (available from Rohm and Haas)
ND = Not Determined Experimental data has established that neither the absolute concentration of oil (trioctanoin) or of surfactant ($C_{16}$DAPS) determines whether or not the enzyme is activated. However, the ratio of the two very accurately describes the kinetic profile seen (even when their absolute concentrations are changed 20-fold). In this case the critical ratio for this combination of oil and surfactant is from 10–20.

A similar series of experiments were carried out using 4 different lipases (concentration in soln ~2 ppm), trioctanoin as an oil, and several different surfactants. The C.R.'s obtained are shown in the following Table IXa.

TABLE IXa

CRITICAL RATIOS FOR LIPASE ENZYMES: TRIOCTANOIN EMULSIONS

| SURFACTANT | | GC-1065 Low | GC-1065 High | AMANO P Low | AMANO P High | AMANO 68S Low | AMANO 68S High | LIPOLASE | |
|---|---|---|---|---|---|---|---|---|---|
| SDS | 1. | 2 mM | 10 mM | 2 mM | 10 mM | 1 mM | 10 mM | | |
| | 2. | 0.5–5.0 | 1–3 | 1–5 | 5–10 | 0.1–0.5 | 10–15 | | |
| | 3. | 325 | 450 | 100 | 200 | 400 | 1200 | | |
| $C_{12}$LAS | 1. | 1 mM | 5 mM | 1 mM | 5 mM | 0.2 mM | 2 mM | 0.5 mM | 5 mM |
| | 2. | 2–10 | 5–10 | 5–10 | 5–10 | 5–10 | 1–5 | 0.5–1 | 0.5–1 |
| | 3. | 250 | 250 | 70 | 70 | 175 | 200 | | |
| Neodol 25-9 | 1. | 0.5 mM | 5 mM | 0.5 mM | 5 mM | 0.5 mM | 5 mM | | |
| | 2. | 10–20 | 10–20 | 1–5 | 0.5–1 | <0.1 | <0.1 | | |
| | 3. | 450 | 450 | 400 | 550 | 750 | 800 | | |
| Neodol 25-3S | 1. | 2 mM | 10 mM | 2.0 mM | 20 mM | 0.5 mM | 10 mM | | |
| | 2. | 0.5–1 | 0.5–1 | 10–20 | 10–20 | 1–5 | 5–10 | | |
| | 3. | 300 | 550 | 200 | 275 | 200 | 200 | | |
| Surfonic JL-80X | 1. | 0.5 mM | 5 mM | 0.5 mM | 5 mM | 0.5 mM | 5 mM | | |
| | 2. | 5–10 | 10–20 | 0.5–1 | <0.2 | 0.5–1 | <0.2 | | |
| | 3. | 500 | 450 | 500 | 800 | 700 | 1500 | | |
| Triton X-100 | 1. | 2 mM | 10 mM | | | | | | |
| | 2. | 10–15 | 15–20 | | | | | | |
| | 3. | 450 | 400 | | | | | | |
| $C_{16}$DAPS | 1. | 0.5 mM | 10 mM | | | | | | |
| | 2. | 10–20 | 10–20 | | | | | | |
| | 3. | 450 | 450 | | | | | | |

1. [Surfactant]mM
2. Critical Ratio
3. Specific Activity (μeq acid/min.mg) determined from initial rates In all the systems studied, a general phenomena is observed. The onset of enzyme activity is almost exclusively determined by the ratio of the respective lipophilic (oil) and surfactant concentrations. The slight shifts in critical ratios occasionally observed with varying concentrations (e.g., Surfonic JL-80X or Triton X-100 with lipase GC-1065) can be explained by invoking lipase/surfactant interactions.

Table IXb shows the activating molar ratio range (R) and enzyme hydrolysis activity (specific hydrolysis activity (μeq acid/min./mg), determined from initial rates) determined from a series of experiments using triolein as the enzyme hydrolysis activator for four lipase enzymes, at low and high surfactant concentrations.

TABLE IXb

CRITICAL (MINIMUM ACTIVATING MOLAR) RATIOS FOR ENZYMES: TRIOLEIN EMULSIONS

| SURFACTANT | | GC-1065 Low | GC-1065 High | AMANO P Low | AMANO P High | AMANO 68S Low | AMANO 68S High | LIPOLASE | |
|---|---|---|---|---|---|---|---|---|---|
| SDS | conc. | 1 mM | 10 mM | 1 mM | 10 mM | 1 mM | 10 mM | | |
| | R | 5-10 | 1-5 | 5-10 | 5-10 | 1-5 | 5-10 | | |
| | Activity | 60 | 50 | 160 | 150 | 200 | 175 | | |
| $C_{12}$LAS | conc. | 0.5 mM | 5 mM | 0.5 mM | 5 mM | 0.5 mM | 5 mM | 0.5 mM | 5.0 |
| | R | 5-10 | 1-5 | 10-20 | 10-20 | 10-20 | 10-20 | 30-40 | 40-50 |
| | Activity | 50 | 60 | 13 | 26 | 30 | 55 | | |
| Neodol 25-9 | conc. | 0.5 mM | 5 mM | 0.5 mM | 5 mM | 0.5 mM | 5 mM | | |
| | R | 10-20 | | 5-10 | 5-10 | 1-5 | 1-5 | | |
| | Activity | 60 | | 20 | 25 | 30 | 30 | | |
| Neodol 25-3S | conc. | 1 mM | 5 mM | 0.5 mM | 5 mM | 0.5 mM | 5 mM | | |
| | R | 1-5 | 0.1-0.2 | 5-10 | N/A | 5-10 | | | |
| | Activity | 125 | 200 | 20 | | 25 | | | |
| Surfonic JL-80X | conc. | 0.5 mM | 2.5 mM | 0.5 mM | 2.5 mM | 2.5 mM | 2.5 mm | | |
| | R | 0.5-1 | 20-40 | 5-10 | 1-5 | 1-5 | 1-5 | | |
| | Activity | 150 | 150 | 40 | 270 | 40 | 180 | | |

Here also, a general ratio dependency is observed. (The most notable exception is the Surfonic JL80X system with lipase GC-1065.) A similar but less dramatic effect was also noticed with trioctanoin. It is possible that at higher concentrations, Surfonic JL80X interacts with lipase GC-1065, perhaps inhibiting hydrolysis of the substrate. This would result in an apparent shift in the critical ratio.

Another point to note from the data in the above Table III, is the decreased hydrolysis observed for triolein compared to trioctanoin (Table IXa).

In order to estimate whether or not a specific lipase will be active in a detergent-containing wash water environment, the molar ratio of hydrolysis activator to surfactant is calculated. Such a use ratio can be calculated based on the wash conditions. The average wash conditions in the U.S., Japan and Europe are compared in Table IXc.

TABLE IXc

| Average Wash Conditions | U.S. | Japan | Europe |
|---|---|---|---|
| Fabric load (kg) | 2-3 | 1-1.5 | 3-4 |
| Wash Liquor (L) | 72 | 45 | 25 |
| Detergent Usage (g/L) | 1.5 | 1.3 | 8-10 |
| Maximum Soil Oil[a] (mM) | 0.11 | 0.094 | 0.475 |

[a]The maximum soil oil was estimated by assuming a triglyceride load of 3g/Kg fabric (Hans Andre et al., Journal of applied Biochm. 2, 218-229 (1980)). The molecular weight of the triglycerides in the soil was assumed to be that of triolein (884).

Based on these wash conditions the use ratios for some common detergents are shown in Table IXd. (The detergent composition and the molecular weights of the surfactants therein were obtained from published data.)

TABLE IXd

| Oil/Surfactant Use Ratios | U.S. | Japan | Europe |
|---|---|---|---|
| Tide (liquid) | 0.13 | 0.12 | 0.07 |
| Tide (solid) | 0.20 | 0.19 | 0.12 |
| Fresh Start | 0.22 | 0.21 | 0.13 |
| Act | 0.19 | 0.18 | 0.11 |
| Clorox Super Detergent | 0.62 | 0.58 | 0.36 |

By comparing the use ratios in Table IXd versus IXb, it can be seen with the CRs (Critical Ratios) for the surfactants present in those detergents and for a lipase to work efficient in the ways, it must either have a low C.R. in that system or a system must be created to reduce the C.R.

Predicting C.R. for detergents from Data in Tables IXa and IXb

The effect of the additives present in a detergent formulation on C.R.s is determined by comparing the C.R.s for lipase GC-1065 (2 ppm) in trioctanoin emulsions made with the detergents "Act", "Clorox Super Detergent" and "Tide" (powder) to those made with their surfactant compositions.

TABLE IXe

| C.R. in Detergent Matrix Versus "Pure" Surfactant | System Studied | C.R. (0.5 mM Surfactant) |
|---|---|---|
| 1. | Detergent: | |
| | Clorox Super Detergent | 20-30 |
| | Pure System: | |
| | Neodol 25-9 | 10-20 |
| 2. | Detergent: | |
| | Act | 5-10 |
| | Pure System: | |
| | Neodol 25-9/Surfonic JL80X | 5-10 |
| 3. | Detergent: | |
| | Power Tide | 1-2.5 |
| | Pure System: | |
| | Neodol 25-3S/$C_{12}$LAS | 1-2.5 |

The detergent compositions and surfactant molecular weights were obtained from published sources.

From Table IXe, it can be seen that the C.R.s for the pure surfactant are very good estimates of what the C.R.s will be a detergent system containing the surfactant, i.e., at use levels, the additives commonly present in a detergent have no dramatic effect on the C.R.s.

USE RATIO

The four enzymes tested (Tables I-IX) all demonstrated a critical ratio for each of the surfactants tested. These surfactants constitute some of the most commonly used surfactants in commercially available detergent compositions. Such detergent compositions are typically recommended for United States laundering use in amounts that, when dissolved in laundry solution, provide a surfactant concentration between about 0.2 mM and about 1.5 mM (assuming a 2–3 kg average load in a 72 liter wash solution).

The average amount of oily soil on fabrics in household laundries is an estimated 300 mg oil/100 g of fabric (Andree et al., *J. App. Biochem,* 2, pp. 218–229 (1980). This indicates that, based on the ratio dependency demonstrated above, inclusion of lipases in most commercially available detergents would provide little or no washing benefit because the use ratio (of actual oil concentration to actual moles of surfactant in the laundering solution) is below the critical ratio at which enzyme activity is initiated. The situation is similar for Europe and Japan because, although the fabric load, wash solution and recommended detergent usage differ from the United States, the use ratios are typically less than about 0.6 for Japan and less than about 0.4 for Europe.

That is, based on the recommended detergent use and considering a wide variety of detergent compositions and surfactant molecular weights, the system ratios for most common detergents are typically less than 1, more usually on the order of about 0.2–0.6. (In calculating the use ratios, the bulk concentrations in solution have been assumed and any possible interfacial effects ignored.) But as can be seen from the data of Tables II–IX, the critical ratio for the common surfactants studied are generally greater than about 1. The performance at use ratios below the critical ratio has made attempts to include lipases in laundering solutions generally ineffective.

Typical detergent compositions for laundering include various additives, such as builder salts. It has been discovered that at use levels the additives commonly utilized in detergents have no substantial effect on the critical ratio (data shown in Tables IXc and IXd).

Use of combinations of surfactants having different critical ratios can generate critical ratios that are different from the individual surfactants in the combination. By practicing the invention, one can admix surfactants to achieve a critical ratio of the combined surfactants that is at or below the lower of the individual critical ratios. This will be further explained hereinafter.

One conventional detergent composition is a mixture of Neodol 25-3S and $C_{12}$LAS (with a molar ratio of 1:0.4). This conventional detergent composition exemplifies the difficulties encountered in prior attempts to include lipases in laundering solutions. By examination of the appropriate data for the component surfactants of the detergent composition in Table VI, one could conclude that the critical ratios are much higher than the use ratio. This conclusion proves true when a swatch study and a washing machine study were conducted, as illustrated by the data of Table X, where a solution included either the conventional detergent or the conventional detergent plus ATCC 53552 enzyme.

TABLE X

| Treatment | Use Ratio[1,2] | Stain Removal[2,3] |
|---|---|---|
| 14 min. washes (Neodol 25-3S and $C_{12}$LAS, 1:0.4 molar ratio), 5 min. rinse | 0.05 | 49.61 |
| 14 min. washes (Neodol 25-3S and $C_{12}$LAS, 1:0.4 molar ratio), and ATCC 53552 enzyme, 5 min. rinse | 0.05 | 51.07 |

[1]Detergent comparisons at 1.29 g/l; enzyme, when present, at 2μg/ml.
[2]Stain: Cotton swatches with sebum soil (synthetic)
[3]% SR(E), as described below.

As illustrated by the data of Table X, the stain removal value of the detergent composition with enzyme was not statistically different from the stain removal value with the detergent composition without enzyme. Thus, the enzyme was substantially not active. Calculation of the use ratio shows the use ratio was below the determined critical ratio of 10–20, and thus the enzyme was inactive.

As earlier noted, soil removal was measured on a stain removal scale designated "% SR(E)". This is a scale expressing the ratio of the change of appearance of a soiled, treated test sample to its maximum possible change of appearance.

$$\%SR(E) = \frac{\Delta E_S - \Delta E_{OW}}{\Delta E_S} \times 100$$

where $E_S$ and $E_{OW}$ are distances in the CIE $L^*a^*b^*$ color space [see, Hunter, The Measurement of Appearance (New York: John Wiley & Sons, 1975) pp. 302–303.] and are given by $$E_S = \sqrt{(L_O^* - L_S^*)^2 + (a_O^* - a_S^*)^2 + (b_O^* - b_S^*)^2}$$

$$E_{OW} = \sqrt{(L^*O - L^*W)^2 + (a^*O - a^*W)^2 + (b^*O - b^*W)^2}$$

in which the subscripts o, s, and w refer to the original unstained and untreated test sample, the stained and the untreated test sample, and the stained and treated test sample, respectively.

The statistical test denoted as the "LSD" refers to the smallest difference between within-group means that would be declared statistically significant at the 95% confidence level using the two-sample test t-test with the variance estimated from all groups in the analysis of variance.

As a brief summary then, enzymes capable of hydrolyzing natural oil stains on fabric when in a laundry solution have been shown to have a dependency for the onset of hydrolysis upon a critical value of the molar use ratio of oil to surfactant in the laundry solution. This critical ratio is dependent upon the type of surfactant in the laundering solution (and also upon the type of oil in the laundering solution). But because the use ratios for most common detergents are typically less than 1 and the critical ratio for the common surfactants studied are generally greater than about 1, lipases generally are inactive.

However, we have discovered ways of "turning on" hydrolysis by the enzyme through hydrolysis activating means for changing the ratio of oil to surfactant or for changing the critical ratio of the surfactants. Examples of ways to modify the critical ratio will now be more fully described. In addition, compositions of the invention may be beneficially formulated with more than one lipase or cutinase.

INCREASING THE SYSTEM RATIO

As explained above, hydrolases can be "turned on" in a laundry solution containing an inactivating surfactant by the addition of an oil to increase the ratio of oil to surfactant therein. This added oil, together with the oil in oily stains, on stained fabrics being washed, constitutes the oil used as numerator in calculating the critical ratio. The added oil does not need to be a substrate for the enzyme.

The addition of non-substrate oil is illustrated by the data of Table XI.

TABLE XI

| Triolein (mM) | Hexadecane (mM) | Surfonic JL-80X (mM) | System Ratio | Enzyme* Activity |
|---|---|---|---|---|
| 0.3 | — | 0.3 | 1 | 0 |
| 1.5 | — | 0.3 | 5 | 15 |
| 0.3 | 1.2 | 0.3 | 5 | 8 |

*As in footnote 3 of Table IA.

As can be seen from the data of Table XI, in the presence of 0.3 mM Surfonic JL-80X, when triolein is at a concentration of 0.3 mM and the system ratio is 1, there is no hydrolase activity. With 1.5 mM triolein, which produces a system ratio of 5, there is hydrolase activity. When 1.2 mM hexadecane was added to the 0.3 mM triolein, the hydrolase also was active.

Mixtures of substrate oils can be used to manipulate the critical ratio also. Table XII demonstrates an example where the oil added is a substrate and is used to increase the system ratio above the critical ratio.

TABLE XII

| Trioctanoin (mM) | Triolein (mM) | Surfonic JL-80X (mM) | System Ratio | Enzyme Activity* |
|---|---|---|---|---|
| 1.87 | 0 | 0.5 | 3.74 | 0 |
| 1.87 | 0.63 | 0.5 | 5 | 51 |
| 0 | 0.25 | 0.5 | 0.5 | 0 |
| 2.25 | 0 | 0.5 | 4.5 | 0 |
| 2.25 | 0.25 | 0.5 | 5 | 56 |

*% total oil hydrolyzed in 14 min. at pH 10 and room temperature.

As seen by the data of Table XII, 0.25 mM triolein, emulsified in 0.5 mM Surfonic JL-80X, is not hydrolyzed by this enzyme. Similarly, 2.25 mM trioctanoin emulsified in 0.5 mM surfonic JL-80X also is not hydrolyzed. However, when both these oils (0.25 mM triolein and 2.25 mM trioctanoin) are emulsified together in 0.5 mM surfonic JL-80X, then 56% of the total oil is hydrolyzed.

Table XIII illustrates use of a preferred non-charged functional group-containing lipophilic organic compound, N,N-diethyldodecanamide, to achieve the desired critical ratio when trioctanoin was the substrate.

TABLE XIII

| Trioctanoin (mm) | N,N-diethyl-dodecanamide (mm) | Neodol 25-9 (mm) | Enzyme Activity* |
|---|---|---|---|
| 2.5 | — | 0.5 | <5 |
| 10.0 | — | 0.5 | 35 |
| — | 10.0 | 0.5 | <5 |
| 2.5 | 2.5 | 0.5 | 5 |
| 2.5 | 5.0 | 0.5 | 12 |
| 2.5 | 7.5 | 0.5 | 19 |

*μeq of fatty acid produced in 14 minutes

The data of Tables XI through XIII were collected using the enzyme from *P. putida* ATCC 53552; however, other enzymes can similarly be activated even in the presence of a surfactant for which the enzyme has a high critical ratio by including an oil that is not a substrate for the enzyme in the detergent composition. This is illustrated by the data of Table XIV, where the enzyme was Amano P.

TABLE XIV

| Trioctanoin (mm) | Hexadecane (mm) | Neodol 25-3S | System Ratio | Enzyme* Activity |
|---|---|---|---|---|
| 5 | — | 0.5 | 10 | 0 |
| 15 | — | 0.5 | 30 | 181 |

TABLE XIV-continued

| Trioctanoin (mm) | Hexadecane (mm) | Neodol 25-3S | System Ratio | Enzyme* Activity |
|---|---|---|---|---|
| 5 | 10 | 0.5 | 40 | 45 |

*As in footnote 3 of Table IA.

REDUCING THE CRITICAL RATIO WITH A MIXTURE OF SURFACTANTS

Mixing a surfactant with a high critical ratio for a particular enzyme with one that has a low critical ratio for that enzyme can sometimes result in a critical ratio for the admixed surfactant which is as low as or even lower than that of the surfactant with the lower of the two critical ratios. A low critical ratio, e.g., below 1 and preferably below 0.5 is desired for most commercial uses. A low critical ratio means that the amount of hydrolysis activator which need be added to the wash water can be reduced.

In order to determine the critical ratio for a particular lipase or cutinase with various surfactants, the hydrolase is tested for hydrolysis activity in an aqueous solution containing a specific surfactant and a predetermined amount of a hydrolyzable substrate. The ratio of surfactant to the substrate is varied while hydrolysis activity is monitored.

Because a desired critical ratio is normally not greater than 1, one or more surfactants may need to be tested (and/or another hydrolase tested) until a critical ratio of less than or about 1 is found. For example, the enzyme tested in Table IA has a critical ratio between 0.5–1 when the surfactant was Neodol 25-3S and the substrate was trioctanoin. The laundry composition may then be formulated by including the lipase or cutinase and the surfactant selected so as to have a critical ratio of less than or about 1.

This use of a mixture of surfactants as a means for lowering the critical ratio of the surfactants viz., the lowest ratio is illustrated by Table XV where trioctanoin was used as the oil, or substrate, and the hydrolase was as in Table II (2 μg/ml). Enzyme activity was measured by initial rates and the reaction was carried out at ambient temperature to an end point pH of 10.00.

TABLE XV

| Mole ratio (SDS:Neodol 25-9) | Critical Ratio (0.5 mM total surfactant) |
|---|---|
| 0:1 | 10–20 |
| 0.025:0.975 | 10–20 |
| 0.05:0.95 | 5–10 |
| 0.1:0.9 | 1–5 |
| 0.2:0.8 | 1–3 |
| 0.5:0.5 | 1–3 |
| 0.75:0.25 | 1–3 |
| 1:0 | 1–3 |

Although the combination shown in Table XV reduced the critical ratio to 1, this is nevertheless not low enough for the enzyme to be active in a conventional laundry system. That is, as may be seen by the data of Table XV, a 0.1–0.2 mole fraction of SDS, when admixed with a high critical ratio surfactant, was effective to reduce the critical ratio of the surfactant admixture to that of SDS alone, but this is not low enough for conventional commercial detergent formulations. Table XVI is an example of another mixture of surfactants which were able to reduce the critical ratio below the system ratio but had a critical ratio too low for use in a conventional laundry system.

TABLE XVI

| Surfactant (0.5 mM) | Trioctanoin (mM) | System Ratio | Enzyme[1] Activity* (μm) |
|---|---|---|---|
| Neodol 25-9 | 2.5 | 5 | 0 |
| | 5.0 | 10 | 0 |
| | 10.0 | 20 | 323 |
| Surfonic JL-80X | 2.5 | 5 | 0 |
| Neodol 25-9/ | 5.0 | 10 | 85 |
| Surfonic JL-60X (1:1) | 2.5 | 5 | 0 |
| | 5.0 | 10 | 67 |

[1]Lipase GC-1065
*As in footnote 3 of TABLE IA.

TABLE XVII

| Surfactant | (mM) | System Ratio | % Total Hydrolysis |
|---|---|---|---|
| Neodol 25-9 | 0.3 | 2 | 0 |
| Neodol 25-9 | 0.13 | 5 | 0 |
| Neodol 25-9 | 0.064 | 10 | 0 |
| Neodol 25-9 | 0.032 | 20 | 18 |
| Neodol 25-9 | 0.016 | 40 | 47 |
| Neodol 25-9 | 0.008 | 80 | 60 |
| Neodol 25-9/ Neodol 25-3S (1:1) | 5.0 | 0.06 | 26 |
| Neodol 25-9/ Neodol 25-3S (1:1) | 2.0 | 0.3 | 35 |
| Neodol 25-9/ Neodol 25-3S (1:1) | 1.0 | 0.6 | 50 |
| Neodol 25-9/ Neodol 25-3S (1:1) | 0.5 | 1 | 53 |
| Neodol 25-9/ Neodol 25-3S (1:1) | 0.3 | 2 | 60 |
| Neodol 25-9/ Neodol 25-3S (1:1) | 0.1 | 6 | 60 |
| Neodol 25-9/ Neodol 25-3S (1:1) | 0.03 | 21 | 60 |

As can be seen from the data of Table XVII, when Neodol 25-9 surfactant at 0.3 mM was used with 0.64 mM of the oil for a system ratio of 2, where was no hydrolysis. However, with a mixture in a 1:1 ratio of Neodol 25-9 and Neodol 25-3S surfactants for the same molar system ratio, there is a 60 percent total hydrolysis. Furthermore, a drop in the system ratio to 0.06 still results in significant hydrolysis of the substrate. This is a surfactant system which is commercially usable.

Table XVIII illustrates another example of where a mixture of high and low critical ratio surfactants synergistically reduces the critical ratio for the admixture to a point below that for either component surfactant. A surfactant composition mixture of $C_{12}$LAS/Neodol 25-9 was prepared at a molar ratio of 2:1 and tested for comparison against each of the individual surfactants.

TABLE XVIII

| Surfactant Composition And Concentration | Critical Ratio |
|---|---|
| $C_{12}$LAS (0.5 mM) | 5-10 |
| $C_{12}$LAS (5.0 mM) | 1-5 |
| Neodol 25-9 (0.5 mM) | 10-20 |
| $C_{12}$LAS/Neodol 25-9 (2 mM/1 mM) | 0.05-0.1 |

In the tests illustrated by the data of Table XVIII, the surfactant mixture showed the *Pseudomonas putida* enzyme activity at a critical ratio between 0.05-0.1. The oil was triolein. By contrast, the Neodol 25-9 surfactant by itself (at 0.5 mM) had a critical ratio of between 10-20 and the critical ratio for $C_{12}$LAS surfactant by itself was 5-10 (at 0.5 mM). Thus, the combination of these two surfactants reduced the critical ratio for the combination to a value below the critical ratio of either surfactant by itself.

COMPOSITIONS OF THE INVENTION

The enzyme compositions of this invention fall into the following general categories:

1. Laundry detergent compositions which consist essentially of an inactivating surfactant, a hydrolysis activator, a hydrolase enzyme and, optionally, one or more other additives conventional in laundry detergents, other than a source of peroxide, e.g., builder, bulking agent, filler, brightener, anti-soil redeposition agent, pigment, fragrance, etc.

2. Laundry additive compositions adapted to be used concurrently with a laundry detergent, whose essential ingredients are a hydrolase enzyme and an amount of a hydrolysis activating agent effective to "turn on" the enzyme in the presence of an amount of the inactivating surfactant normally present in laundry wash water.

In both types of compositions, a source of peroxy oxygen, e.g., a perborate, can also be present.

The hydrolysis activator in the detergent composition can be either or both of an essentially water insoluble non-charged lipophilic compound, e.g., a triglyceride or an oily hydrocarbon or functional group containing essentially hydrocarbonaceous organic compound, or a water dispersible nonionic surfactant which lowers the critical ratio of the hydrolysis activator(s) to the surfactant to a level low enough that the oil present in the dirty fabrics to be laundered or in the enzyme composition or in both, is sufficient to activate the enzyme.

The enzyme laundry additive compositions optionally contain a surfactant which is effective, alone or in combination with another activator present therein, to bring the system ratio for the composition above the critical ratio and, if the composition is intended to be used in the wash water in conjunction with a separate detergent laundry composition, instead of as a pre-soak, above the critical ratio for the surfactant provided by the detergent in the wash water.

Enzyme Additive Composition

The following illustrates the components of an enzyme composition suitable for use as a pre-wash soaking composition or as an additive to be added to a conventional detergent-containing home laundry washing solution.

| Component | Wt. % |
|---|---|
| Surfactant (Neodol 25-9) | 6 |
| Lipase Enzyme | 1 |
| Sodium perborate (to deliver ≧ 20 ppm A.O. per 100 g use dose of the composition) | 10 |
| Precursor (peroxide activator) NOGPS* | 7.1 |
| Oil N,N-diethyldodecamide | |
| Other ingredients (fillers) | remainder |

*nonanoyloxyglycoylphenyl sulfonate (U.S. 4,778,618)

Enzyme Detergent Composition

The following illustrates the components of an enzyme detergent composition suitable for use as a laundry detergent.

| Component | wt. % |
|---|---|
| Surfactants (linear alkylbenzene sulfonate) | 8 |
| (Neodol 25-9) | 4 |
| Lipase Enzyme (GC-1065) | 1.38 |
| Sodium Perborate (peroxy bleach) | 10 |
| (to deliver 20-80 ppm A.O. per 100 g use dose of the composition) | |
| Hydrolysis Activator (trioctanoin) | 20.3% |
| Other solid conventional detergent ingredients | remainder |

A preferred detergent composition useful in unit amounts to launder fabric having a triglyceride stain or soil thereon, comprises a surfactant formulation providing from about 0.2 mM to about 1.5 mM surfactant concentration when a unit amount of the total composition is dissolved in a laundry solution. Particularly preferred compositions include an enzyme isolatable from *P. putida* ATCC 53552 and in an amount sufficient to hydrolyze at least about 5 wt. % triglyceride on fabric when a unit amount of the total composition is dissolved in a laundry solution.

For example, a composition of the invention was prepared by admixing the nonionic surfactant Neodol 23-6.5 and the nonionic surfactant Surfonic JL-80X in a 1:0.2 mole ratio. Additional additives and proportions were:

| Component | wt. % |
|---|---|
| Surfactants (Neodol 23-6.5/ Surfonic JL-80X) | 3.7 |
| deionized water | 26.0 |
| sodium tripolyphosphate | 0.6 |
| sodium carbonate | 10.5 |
| sodium polysilicate[1] | 1.5 |
| alkaline proteases[2,3] | 0.8/0.6 |
| brightener[4] | 0.9 |
| pigment | 0.1 |
| fragrance | 0.2 |

[1]Trademark Britesil (PQ Corporation)
[2]Trademark Alcalase (Novo Industries)
[3]Trademark Savinase (Novo Industries)
[4]Trademark Tinopal 5BM-XC (Ciba-Geigy A.G.)

The hydrolase included in this detergent composition was grown and isolated from *P. putida* ATCC 53552 as is described in Wiersema et al., European Patent Application 268,456, published May 25, 1988, but also set out below for the reader's convenience.

(A) Seeding and Fermenting

A seed medium was prepared with 0.6% nutrient broth (Difco) and 1% glucose (pH 6.5). 100 ml of this medium was sterilized in 500 ml fernbach flasks. The flasks were each seeded with a loopful from an overnight culture of *P. putida* ATCC 53552 grown on nutrient agar, and placed on a New Brunswick shaker at 250 rpm, 37° C. for 12 hours. The incubated 12-hour culture was then seeded at appropriate volumes (1-10% v/v) into a 1 liter fermenter (250 ml working volume), a 15 liter Biolafitte fermenter (12 liters working volume), or a 100 liter Biolafitte fermerter provided with a temperature controller, RPM, airflow and pressure controller. The fermenter medium contained 0.6% nutrient broth (Difco), 0.3% apple cutin, and 0.2% yeast extract (Difco), with an initial pH of 6.5. The medium was adjusted to pH 6.8 and sterilized for 40 minutes before seeding. Bacterial growth and enzyme production were allowed to continue in the fermenter for 12-15 hours.

(B) Enzyme Recovery by Microfiltration

The crude fermentation culture was first filtered in a Amicon unit outfitted with two Romicon microporous membranes (0.22$\mu$) to remove cells. Remaining enzyme in the retentate which was bound to the cutin particles was removed by centrifugation. Total recovery approached 90%.

(C) Concentration and Dialysis of Whole Cell Filtrate

The recovered filtrate from the Amicon unit was concentrated to a volume of 3 liters on an Amicon ultrafiltration unit with two Romicon Pm 10 modules. The concentrated material was then dialised with 20 liters of 0.01M phosphate buffer, pH 7.5, to remove salts and color. Recovery at this stage averaged about 80%. Total activity for this crude preparation was $8.68\times10^6$ units. A unit of lipase activity is defined as the amount of enzyme which results in an increase of absorbance at 415 nm of 1.0/minute when incubated at 20° C. with mM p-nitrophenylbutyrate in 0.1M pH 8.0 Tris-HCl buffer containing 0.1wt. % Triton X-100.

(D) Complete Isolation of the Hydrolase

The desired enzyme may be separated completely from another enzyme also with lipase activity by chromatography on hydrophobic resins. The enzyme solution of Example III(C) after ultrafiltration and difiltration was adjusted to 0.5M NaCl and applied to a $0.8\times7$ cm octyl Sepharose column equilibrated in 10 mM Tris(Cl), pH 8, 0.5M NaCl and washed to removed unbound protein. The following washes were then employed: 10 mM Tris(Cl), pH 8, 7M urea; 10 mM Na phosphate, pH 8; 10 mM phosphate, pH 8, 0.5M NaCl. After washing, the column was then developed with a linear gradient to 50% n-propanol. The column fractions were then assayed for activity on p-nitrophenyl butyrate (PNB) and p-nitrophenyl caprylate (PNC) in order to locate the lipase activities. Two enzymes were clearly resolved, fraction 32 with a PNB/PNC ratio of 4.6 (which is the desired enzyme) and fraction 51 with a PNB/PNC ratio of 1.40.

IMPROVED OILY STAIN REMOVAL

Both swatch studies and washing machine studies were conducted with compositions of the invention as will now be described.

In the swatch study (1), 2 ppm hydrolase was admixed with the detergent composition previously described as inventive composition (a). In a washing machine study (1), 20 ppm hydrolase was admixed with this composition. Both studies included staining fabrics with synthetic sebum soil. The synthetic sebum soil was prepared as follows. Ten oils having the following proportions were admixed:

| Oils | % w/w |
|---|---|
| Stearic acid | 5 |
| Squalene | 5 |
| Cholesterol | 5 |
| Linoleic acid | 5 |
| Oleic acid | 10 |
| Paraffin oil | 10 |
| Palmitic acid | 10 |
| Coconut oil | 15 |
| Sperm wax | 15 |
| Olive oil | 20 |

To 15 g of the above melted oils was added 0.6 g oleic acid, 1.2 g triethanolamine and 0.225 g charcoal. Then 60 ml water at 130° F. was admixed, and the mixture blended for 1 minute.

Swatch Study (1)

Cotton swatches were stained with the synthetic sebum soil and then washed in test beakers by agitating for 14 minutes followed by a 5 minute rinse. The laundering solution was 0.205 g of inventive composition(a) dissolved in 250 ml water. A control composition without the hydrolase was also prepared and used to treat stained cotton swatches by the same protocol. Table XIX shows the stain removal for the inventive composition (a) and for the control composition.

TABLE XIX

| Composition | System Ratio[1] | % SR(E)[2] |
|---|---|---|
| Inventive comp. (a) | 0.08 | 60.72 |
| Control | 0.08 | 57.37 |

[1]Calculated from concentrations of surfactant and the olive and coconut oils.
[2]LSD = 2.23 at 0.95 confidence level.

As may be seen from the swatch study data of Table XIX, statistical enhancement of soil removal was seen for the inventive composition.

Washing Machine Study (1)

Polyester swatches were stained with sebum, vegetable oil or olive oil. These swatches were then washed for 12 minutes at 96 F. in a 72 liter washing machine, rinsed in the normal rinse cycle and then allowed to air dry. One set of swatches was treated in laundering solution having 59 g inventive composition(a) dissolved therein while another set of swatches was treated with a control composition identical to inventive composition (a) but without the hydrolase. The stain removal data, expressed as % SR(E), is shown by Table XX.

TABLE XX

| Composition | Sebum[1] | Vegetable Oil[2] | Olive Oil[3] |
|---|---|---|---|
| Inventive comp. (a) | 89.69 | 51.82 | 60.79 |
| Control | 83.75 | 29.20 | 35.05 |

[1]LSD = 1.52
[2]LSD = 6.08 (Wesson brand oil)
[3]LSD = 5.60

As can be seen from the data of Table XX, statistically significant stain removal was achieved for all stains tested on polyester fabric.

Swatch and Washing Machine Study (2)

The polycotton fabric was cut into 2"×2" swatches, each weighing about 0.39 g. The desired amount of triolein was dissolved in 2-methyl pentane, and pipetted onto each swatch (200 μL/swatch). The triolein stain was allowed to wick out for 72 hrs. at room temperature. The reflection of the stain was then evaluated using a Hunter Spectracolorimeter, and a prewash value (proportional to the concentration of the absorbing species) was determined.

The soiled swatches were divided into groups of 4 and loaded into 250 ml bottles, each with 200 ml of the desired treatment. The bottles were then shaken for 12 minutes at room temperature, and rinsed twice with 200 ml of dd $H_2O$. Finally they were air dried and the post-wash value (proportional to the concentration of the absorbing species) determined.

Comparative Treatment A: The swatches were washed in a surfactant composition of 0.3 mM $C_{12}$LAS/Neodol 25-9 in a 2:1 molar ratio. No lipase was added.

Inventive Treatment B: Same as A, except for the addition of a 5 ppm lipase ATCC 53552 to the surfactant composition.

Comparative Treatement C: The swatches were washed in an alternate formulae containing the surfactant composition of 0.3 mM $C_{12}$LAS/Neodol 25-9, in a molar ratio of about 1:4. No lipase was added.

Inventive Treatment D: Same as treatment C, except for the addition of 5 ppm lipase ATCC 53552 to the surfactant composition.

The amount of oily stain removed in each treatment is summarized by Table XXI.

TABLE XXI

| Oil loaded | | System | | % Triolein | |
|---|---|---|---|---|---|
| %* | mM** | Ratio | Treatment | Removal*** | LSD |
| 1 | 0.072 | 0.24 | A (comparative) | 44 | 3.8 |
| 1 | 0.072 | 0.24 | B (inventive) | 55 | |
| 3 | 0.22 | 0.73 | A (comparative) | 29 | 3.7 |
| 3 | 0.22 | 0.73 | B (inventive) | 34 | |
| 1 | 0.072 | 0.25 | C (comparative) | 39 | 4.5 |
| 1 | 0.072 | 0.25 | D (inventive) | 60 | |
| 3 | 0.22 | 0.76 | C (comparative) | 27 | 3.6 |
| 3 | 0.22 | 0.76 | D (inventive) | 33 | |

*% Triolein loaded reflects the grams of oil per 100 g of fabric.
**The mM concentrations were calculated based on bulk concentrations of oil and surfactants.
***% removal was calculated by comparing the pre and post wash values to a standard curve vs oil on swatch.

As may be seen by the data of Table XXI, use of a composition in accordance with the invention removed from 33% to 60% of the oil on the polycotton fabric, and this removal was distinctly better for the inventive composition (including the hydrolase) than without hydrolase. The LSD values show this removal was statistically significant.

In sum, enzyme compositions of the invention are useful in laundering solutions and comprise an enzyme capable of hydrolyzing natural oil stains on fabric when in a laundry solution and hydrolysis activating means for changing the ratio of oil to surfactant or for changing the critical ratio of the surfactants. Several embodiments of hydrolysis activating agents have been exemplified for use in laundry solutions so that the enzyme will be active in hydrolyzing the oil stains. One can usually observe the onset of hydrolysis when the enzyme has an activity sufficient to hydrolyze at least about 5 wt. % of total triglyceride stains within about 14 or 15 minutes at about 25° C. Without the hydrolysis activating means of the invention, the enzyme is normally inhibited from hydrolyzing natural oily soils or stains when the laundering solution contains between about 0.1 mM to 5 mM of surfactant. Another way of stating the effect of the hydrolysis activating means of the invention is that when a lipase or cutinase is admixed with a surfactant formulation in accordance with this invention, then the lipase or cutinase is capable of hydrolyzing at least about 30 mg triolein when a unit amount of laundering composition is dissolved in aqueous solution at 25° C. at pH 10 with an average rate of about 0.0072 mmoles/min fatty acid being produced over about 14 minutes. Thus, surfactant systems may be formulated in accordance with the invention that include lipases and/or cutinases for use in laundering solutions without requiring extended soaking or high temperatures.

Although the present invention has been described with reference to specific examples, it should be understood that various modifications and variations can be easily made by those skilled in the art without departing from the spirit of the invention. Accordingly, the foregoing disclosure should be interpreted as illustrative only and not to be interpreted in a limiting sense. The present invention is limited only by the scope of the following claims.

What is claimed is:

1. An enzyme composition adapted for use in a surfactant-containing laundry solution for laundering oily soiled or oily stained fabric, which comprises:

a hydrolytic enzyme which is susceptible to being at least partially inactivated by the surfactants present in laundry detergent compositions, in an amount effective to hydrolyze the fatty esters present in oily stains on or in oily soil in fabric laundered in an aqueous solution of the enzyme composition; and at least one non-ionically charged enzyme hydrolysis activator selected from the group consisting of (a) water insoluble oily hydrocarbons; (b) hydrolyzable lipophilic oily substrates for the enzyme; (c) essentially lipophilic organic compounds which are no more than 1% soluble in water and which bear a polar functional group and which are not a substrate for the enzyme; and (d) a water dispersible aliphatic alkyl polyalkyleneoxy ether nonionic surfactant having an alkyleneoxy to alkyl molecular weight ratio from about 1:1 to about 3:1, in an amount effective to prevent the enzyme from being inactivated by a conventional amount of any surfactant present in a laundry solution to which the enzyme composition is added, with the proviso that when the enzyme is isolatable from Pseudomonas ATCC 53552 and the hydrolysis activator is (b), the enzyme composition is substantially free from a source of peroxy oxygen.

2. The enzyme composition of claim 1, wherein the hydrolysis activator as defined therein comprises (a).

3. The enzyme composition of claim 2, wherein the hydrolysis activator comprises hexadecane or octadecane.

4. The enzyme composition of claim 1, wherein the hydrolysis activator as defined therein comprises (b).

5. The enzyme composition of claim 4, wherein the hydrolysis activator comprises trioctanoin or triolein.

6. The enzyme composition of claim 1, wherein the hydrolysis activator as defined therein comprises (c).

7. The enzyme composition of claim 6, wherein the hydrolysis activator comprises N,N-diethyldodecanamide.

8. The enzyme composition of claim 1, wherein the hydrolysis activator as defined therein comprises (d).

9. The composition of claim 8, wherein the enzyme is isolatable from an organism containing and using a gene obtainable from a Pseudomonas, a Chromobacter, an Aspergillus, an Acinetobacter or a Fusarium.

10. The enzyme composition of claim 8, wherein the enzyme is isolatable from *Pseudomonas putida* ATCC 53552, or is a mutant thereof or a clone thereof.

11. An enzyme composition of claim 1, which further comprises an amount of a surfactant which, in the absence of the hydrolysis activator, would at least partially inactivate the enzyme.

12. The surfactant and enzyme composition of claim 11, wherein the molar ratio of hydrolysis activator to the surfactant which would, in the absence of the hydrolysis activator, inactivate the enzyme, is greater than about 0.5.

13. The surfactant and enzyme composition of claim 11, wherein the enzyme inactivating surfactant is selected from the group consisting of alkyl sulfates, alkylaryl sulfonates and polyalkyleneoxy sulfonates.

14. The surfactant and enzyme composition of claim 11, wherein the hydrolysis activator as defined therein comprises (a).

15. The surfactant and enzyme composition of claim 11, wherein the hydrolysis activator as defined therein comprises hexadecane or octadecane.

16. The surfactant and enzyme composition of claim 11, wherein the hydrolysis activator as defined therein comprises (b).

17. The surfactant and enzyme composition of claim 16, wherein the hydrolysis activator comprises trioctanoin or triolein.

18. The surfactant and enzyme composition of claim 11, wherein the hydrolysis activator as defined therein comprises (c).

19. The surfactant and enzyme composition of claim 18, wherein the hydrolysis activator comprises N,N'-diethyldodecanamide.

20. The surfactant and enzyme composition of claim 11, wherein the hydrolysis activator as defined therein comprises (d).

21. The surfactant and enzyme composition of claim 20, wherein the inactivating surfactant is an alkylsulfate or an alkylarylsulfonate and the hydrolysis activator means comprises an alkyl polyalkyleneoxy ether nonionic surfactant.

22. The surfactant and enzyme composition of claim 11, wherein the enzyme is a lipase isolatable from an organism containing and using a gene obtainable from a Pseudomonas, a Chromobacter, an Aspergillus, an Acinetobacteror, a Fusarium.

23. The surfactant and enzyme composition of claim 22, wherein the enzyme is a lipase isolatable from *Pseudomonas putida* ATCC 53552, or is a mutant thereof or a clone thereof.

24. A laundry detergent composition comprising, an enzyme composition of claim 11 and one or more of a builder, bulking agent, filler, brightener, anti-soil redeposition agent, pigment and fragrance.

25. The detergent composition of claim 24, wherein the enzyme is a lipase.

26. The detergent composition of claim 24, wherein the enzyme is isolatable from an organism containing and using a gene obtainable from a Pseudomonas, a Chromobacter, an Aspergillus, an Acinetobacter or a Fusarium.

27. The detergent composition of claim 26, wherein the enzyme is isolatable from *Pseudomonas putida* ATCC 53552 or is mutant thereof or a clone thereof.

28. The detergent composition of claim 24, wherein the enzyme inactivating surfactant is selected from the group consisting of alkyl sulfates, alkylaryl sulfonates and polyalkyleneoxy sulfonates.

29. The enzyme composition of claim 1, further comprising a source of peroxy oxygen and whose enzyme hydrolysis activator as defined therein comprises (a).

30. The enzyme composition of claim 1, further comprising a source of peroxy oxygen and whose enzyme hydrolysis activator as defined therein comprises (c).

31. The enzyme composition of claim 1, further comprising a source of peroxy oxygen and whose enzyme hydrolysis activator as defined therein comprises (d).

32. The enzyme composition of claim 29, wherein the inactivating surfactant is an alkylsulfate or an alkylarylsulfonate and the hydrolysis activator means comprises an alkyl polyalkyleneoxy ether nonionic surfactant.

33. The enzyme composition of claim 29, wherein the source of peroxy oxygen is sodium perborate.

34. The detergent composition of claim 24, further comprising a source of peroxy oxygen and the enzyme hydrolysis activator is (a).

35. The detergent composition of claim 24, further comprising a source of peroxy oxygen and the enzyme hydrolysis activator is (c).

36. The detergent composition of claim 24, further comprising a source of peroxy oxygen and the enzyme hydrolysis activator is (d).

37. In a method for washing oily soiled or oily stained fabric in a laundry solution containing a surfactant and an amount of a hydrolase enzyme which, in the absence of the surfactant, is capable of hydrolyzing the triglycerides in the oily stain or soil but which in the presence of the surfactant and in the absence of a hydrolysis activator defined hereinbelow, is at least partially inactivated by the surfactant, the improvement which comprises adding to the laundry solution a hydrolysis activator selected from the group consisting of (a) water insoluble oily hydrocarbons; and (b) hydrolyzable lipophilic substrates for the enzyme; (c) essentially lipophilic organic compounds which are no more than 1% soluble in water and which bear a polar functional group and which are not a substrate for the enzyme; and (d) a non-charged water dispersible aliphatic alkyl polyalkyleneoxy nonionic surfactant having an alkyleneoxy to alkyl molecular weight ratio from about 1:1 to about 3:1 in an amount effective to prevent the enzyme from being inactivated by the surfactant present in the laundry solution, with the proviso that when the enzyme is isolatable from Pseudomonas ATCC 53552 and the hydrolysis activator is (b), the laundry solution is substantially free of a source of peroxy oxygen.

38. The method of claim 37, wherein the hydrolysis activator as defined therein comprises (a).

39. The method of claim 37, wherein the hydrolysis activator as defined therein comprises (b).

40. The method of claim 37, wherein the hydrolysis activator as defined therein comprises (c).

41. The method of claim 37, wherein the hydrolysis activator as defined therein comprises (d).

42. The method of claim 37, wherein the enzyme is isolatable from an organism containing and using a gene obtainable from a Pseudomonas, a Chromobacter, an Aspergillus, an Acinetobacter or a Fusarium.

43. The method of claim 37, wherein the enzyme is isolatable from *Pseudomonas putida* ATCC 53552, or is a mutant thereof or a clone thereof.

44. A method for rendering a hydrolase enzyme-containing laundry additive composition enzymatically predictably effective in assisting in the removal of oily stains and soil from fabric in laundry solutions containing a conventional amount of a separately added surfactant-containing laundry detergent, which comprises adding to the enzyme composition an amount of a hydrolase activator, effective to prevent the surfactant in the laundry solution from inhibiting the enzymatic activity of the enzyme added thereto.

45. The method of claim 44, wherein the hydrolysis activator comprises a water insoluble oily hydrocarbon.

46. The method of claim 44, wherein the hydrolysis activator comprises a hydrolyzable lipophilic oily substrate for the enzyme.

47. The method of claim 44, wherein the hydrolysis activator comprises an essentially lipophilic organic compound which is no more than 1% soluble in water and which bears a polar functional group and which is not a substrate for the enzyme.

48. The method of claim 44, wherein the hydrolysis activator comprises a water dispersible aliphatic alkyl polyalkyleneoxy ether nonionic surfactant having an alkyleneoxy to alkyl molecular weight ratio from about 1:1 to about 3:1.

49. The method of claim 44, wherein the enzyme is isolatable from an organism containing and using a gene obtainable from a Pseudomonas, a Chromobacter, an Aspergillus, an Acinetobacter or a Fusarium.

50. The method of claim 44, wherein the enzyme is isolatable from *Psesudomonas putida* ATCC 53552, or is a mutant thereof or a clone thereof.

* * * * *